US005123820A

United States Patent [19]

Lauter

[11] Patent Number: 5,123,820

[45] Date of Patent: Jun. 23, 1992

[54] PRESSURE ASSISTED APEX SEAL WITH STEPPED SLOT

[75] Inventor: Jonathan M. Lauter, Great Neck, N.Y.

[73] Assignee: John Deere Technologies, International, Inc., Wood-Ridge, N.J.

[21] Appl. No.: 560,718

[22] Filed: Jul. 31, 1990

[51] Int. Cl.[5] ..... F01C 19/04

[52] U.S. Cl. ..... 418/123

[58] Field of Search ..... 418/113, 119-124

[56] References Cited

U.S. PATENT DOCUMENTS

| | | | |
|---|---|---|---|
| 2,866,417 | 12/1958 | Nubling | 418/123 |
| 3,207,426 | 9/1965 | Gassmann et al. | 418/124 |
| 3,551,080 | 12/1970 | Feller | 418/124 |
| 3,758,243 | 9/1973 | Fox, Jr. | 418/124 |
| 3,873,250 | 3/1975 | Batten | 418/123 |
| 4,317,648 | 3/1982 | Shimizu et al. | 418/120 |

FOREIGN PATENT DOCUMENTS

| | | | |
|---|---|---|---|
| 1201137 | 9/1965 | Fed. Rep. of Germany | 418/123 |

*Primary Examiner*—John J. Vrablik

*Attorney, Agent, or Firm*—Robin, Blecker, Daley & Driscoll

[57] ABSTRACT

A rotary internal combustion engine includes a rotor with apex seals installed in slots which extend axially through apexes of the rotor. Each slot has stepped side walls which define an inner narrower slot portion and an outer wider slot portion. The portion are joined by a pair of outwardly facing ledges on both sides of the slot. Each apex seal has a outer head which includes a pair of overhanging or cantilevered lips. The width of the overhang is slightly larger than the width of the ledges so that seal-slot contact is made near the outer seal tip.

3 Claims, 1 Drawing Sheet

PRESSURE ASSISTED APEX SEAL WITH STEPPED SLOT

BACKGROUND OF THE INVENTION

This invention relates to rotary internal combustion engines, and more particularly, to improved apex seals therefore.

In conventional rotary engines, apex seals are mounted in slots in the rotor with a certain clearance which allows the seal to move radially and maintain contact with the housing running surface. However, gas pressure acting on the outer exposed surface of the apex seal may cause the seal to move away and separate from the running surface. Attempts have been made to solve this problem by using tiltable seals, seal-slot clearances and seals with overhanging or cantilevered lips to allows gas pressure to act on the radially inwardly facing seal surfaces and push the seal towards the running surface. However, it has been found that too large a cantilever increases the side loading of the seal. This, in turn, increases seal-slot friction which can interfere with the desired radial movement of the apex seal.

SUMMARY OF THE INVENTION

An object of the present invention is to provide a rotary engine with an apex seal arrangement wherein engagement between the seal and the running surface engagement is consistently maintained.

These and other objects are achieved by the present invention in a rotary internal combustion engine which includes a housing and a rotor movable in the housing and subjected to the heat and pressure of combustion gasses. Apex seals are received by slots in the rotor. Each slot has stepped side walls which define an inner narrower slot portion and an outer wider slot portion. The portions are joined by a pair of outwardly facing ledges on both sides of the slot. Each apex seal has an outer head which includes a pair of overhanging or cantilevered lips. The width of the overhang is slightly larger than the width of the ledges so that seal-slot contact is made near the outer seal tip. This reduces any bending forces and reduces seal side loading. The ledge also reduces the side area of the seal which is directly exposed to high gas pressure, thus further reducing seal-slot loads. These factors reduce the seal-slot friction, thereby improving the ability of the seal to stay in contact with the housing running surface without leakage or increased engagement force.

DETAILED DESCRIPTION

Figure 1:
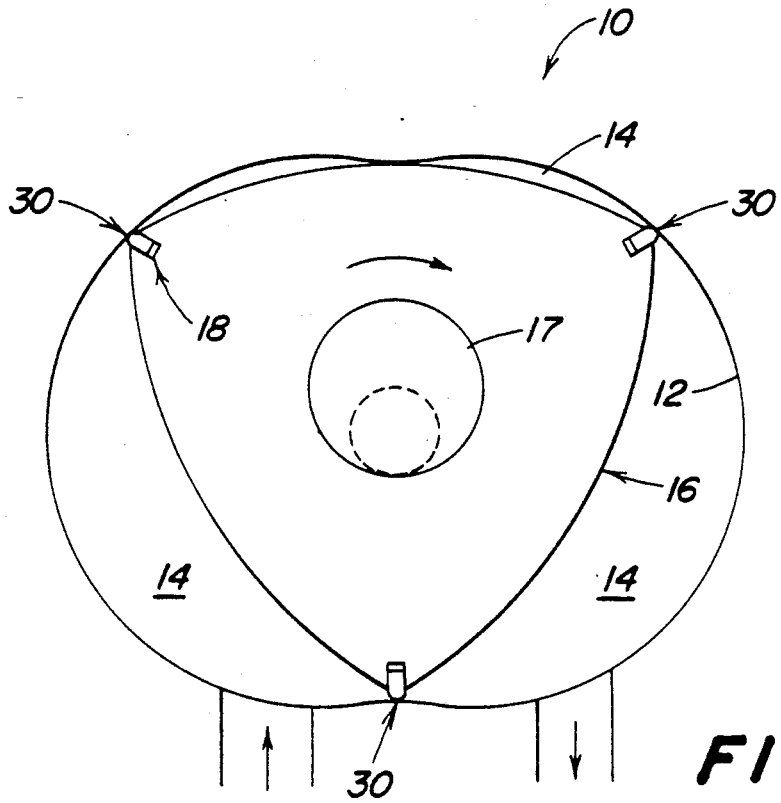
FIG. 1 is a simplified diagrammatic view of a rotary piston internal combustion engine which illustrates the environment in which to the present invention may be used.
Figure 2:
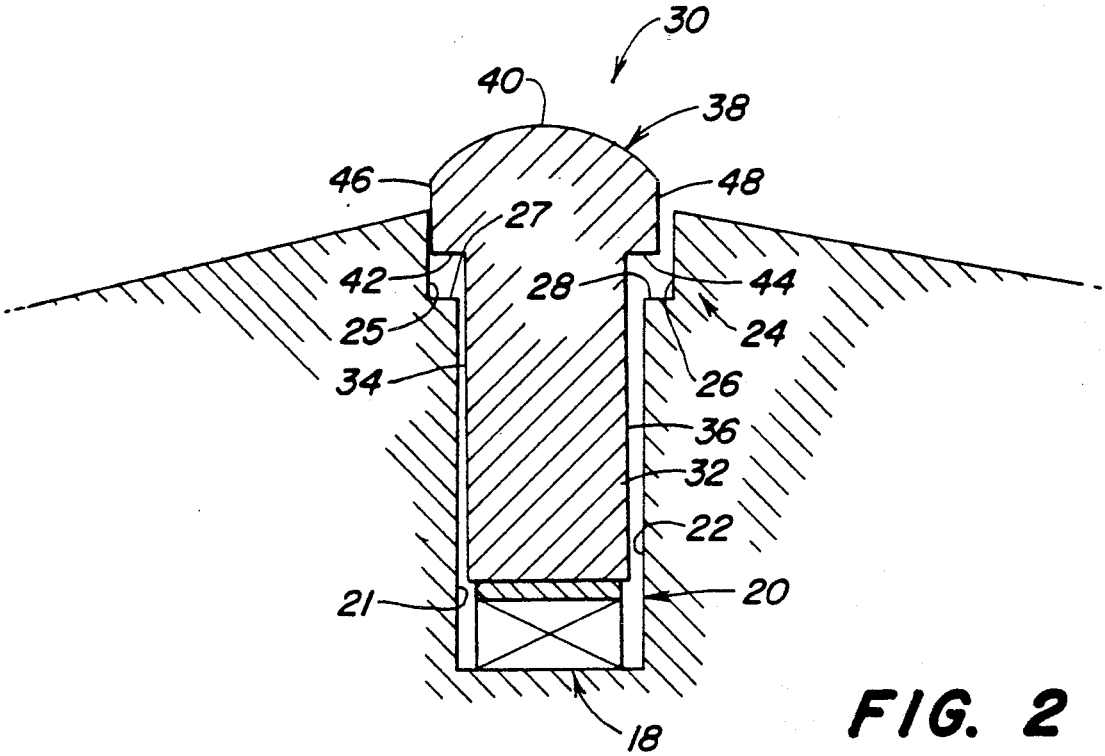
FIG. 2 is an enlarged view of the apex seal arrangement of the present invention.

Referring to FIGS. 1 and 2, a rotary internal combustion engine of the Wankel type includes a housing 10 which defines an inner running or working surface 12. A three-lobed rotor 16 is movable in the housing 10 about a conventional eccentric 17. The housing 10 and the rotor 16 define three working chambers 14 therebetween. A stepped slot 18 extends axially through each apex of the rotor. Each slot 18 has a narrow inner portion 20 with side walls 21, 22 and a wider outer portion

24 with side walls 25, 26. The inner portion 20 may be slightly tapered from a wider upper portion to a narrower lower portion, viewing FIG. 2. Portions 20 and 24 are joined by radially outwardly facing ledges 27,28.

Each slot receives an apex seal member 30 which is allowed to move radially within slot 18 in order to remain in contact with the running surface 12 and which is urged radially outwardly by a conventional under-seal spring. Each apex seal member includes a base portion 32 which has a rectangular cross-section with side walls 34,36 and a head portion 38 with rounded outer surface 40. The head and the base define a pair of radially inwardly facing lip surfaces 42,44, which are connected to surface 40 by side walls 46,48. The side walls 46,48 of the apex seal head have a radial dimension which is greater than a radial dimension of the side walls 25,26 of the outer slot portion 24. There is a small space or orifice between seal surface 48 and rotor slot surface 26. This orifice reduces the pressure from the high pressure side of the apex seal 30 which is communicated via this orifice past the side of the apex seal 30 and down to the area underneath the apex seal 30 where the reduced pressure helps to urge the apex seal 30 radially outwardly and into engagement with the running surface 12. Because the orifice is formed between surfaces 48 and 26 and near the radially outer portion of the apex seal 30, only the extreme outer tip portion of the apex seal 30 is exposed directly to the high pressure in the working chamber on the right side of the apex seal 30.

The width of the lips or overhangs 42,44 is slightly larger (by approximately 0.001 to 0.003 inches) than the width of the ledges 27,28 and the seal and slot are dimensioned so that, when the seal is moved to one side of the slot, seal-rotor contact is made by the side wall 46 of seal head 38 with slot side wall 25 or by side wall 48 of seal head 38 with slot side wall 26. This engagement prevents engagement between an outer portion of the base 32 and an outer portion of a side wall 21 of the inner slot portion 20. This arrangement reduces any bending forces and reduces seal side loading, thereby reducing seal-slot friction and improving the ability of the seal 30 to stay in contact with the housing running surface 12 without leakage or increased engagement force.

While the invention has been described in conjunction with a specific embodiment, it is to be understood that many alternatives, modifications and variations will be apparent to those skilled in the art in light of the foregoing description. For example, the principles of this invention could be applied to multiple-piece apex seal assemblies, such as shown in U.S. Pat. No. 4,317,648, issued 2 Mar. 1982 to Shimizu et al, or as shown in U.S. patent application Ser. No. 549,844, filed 9 Jul. 1990, and assigned to the assignee of the present application. Accordingly, this invention is intended to embrace all such alternatives, modifications and variations which fall within the spirit and scope of the appended claims.

I claim:

1. An apex seal arrangement for a rotary engine having a housing defining an inner working surface surrounding a working chamber, and a rotor movable in the working chamber the rotor having a slot in an apex thereof, the slot receiving an apex seal for slidably and sealingly engaging the working surface, characterized by:

the slot having a narrower inner portion and a wider outer portion, both with radially extending side walls, said portions being joined by a radially outwardly facing ledge; and the apex seal being freely movable from side to side within the slot, and having a narrower base received in the inner slot portion and a wider head received in the outer slot portion, the base and the head defining a radially inwardly facing lip, the lip having a width which is greater than a width of the ledge and the seal and slot being dimensioned so that when the seal is moved to one side of the slot the seal head will engage the side wall of the outer slot portion and prevent engagement between an outer portion of the base and an outer portion of the side wall of the inner slot portion.

2. The apex seal arrangement of claim 1, wherein:

the head of the apex seal comprises a pair of radially extending side surfaces which are engageable with the side walls of the outer slot portion.

3. The apex seal arrangement of claim 1, wherein:

the side surfaces of the apex seal head have a radial dimension which is greater than a radial dimension of the side walls of the outer slot portion.

* * * * *